US007731453B2

(12) United States Patent
Stein

(10) Patent No.: US 7,731,453 B2
(45) Date of Patent: Jun. 8, 2010

(54) METHOD AND DEVICE FOR TRENCHLESS LAYING OF PIPELINES

(75) Inventor: Dietrich Stein, Bochum (DE)

(73) Assignee: Stein & Partner GmbH, Bochum (DE)

( * ) Notice: Subject to any disclaimer, the term of this patent is extended or adjusted under 35 U.S.C. 154(b) by 672 days.

(21) Appl. No.: 10/580,668

(22) PCT Filed: Nov. 11, 2004

(86) PCT No.: PCT/EP2004/012954

§ 371 (c)(1),
(2), (4) Date: Apr. 23, 2007

(87) PCT Pub. No.: WO2005/061836

PCT Pub. Date: Jul. 7, 2005

(65) Prior Publication Data

US 2007/0292212 A1 Dec. 20, 2007

(30) Foreign Application Priority Data

Nov. 28, 2003 (DE) ..... 103 56 696

(51) Int. Cl.
*E02B 7/20* (2006.01)
*E21C 39/00* (2006.01)

(52) U.S. Cl. ..... 405/184; 405/138; 405/141; 405/146; 405/150.1; 405/150.2

(58) Field of Classification Search ..... 405/138, 405/141, 146, 184, 258.1, 263, 270, 150.1, 405/150.2; 299/1.3, 1.8
See application file for complete search history.

(56) References Cited

U.S. PATENT DOCUMENTS

| | | | | |
|---|---|---|---|---|
| 4,116,011 | A * | 9/1978 | Girault | 405/134 |
| 4,774,470 | A * | 9/1988 | Takigawa et al. | 324/337 |
| 5,324,139 | A * | 6/1994 | Wagner et al. | 405/146 |
| 5,527,135 | A * | 6/1996 | Hayashi et al. | 405/184 |
| 6,565,285 | B1 * | 5/2003 | Landrichter | 405/155 |

FOREIGN PATENT DOCUMENTS

| | | |
|---|---|---|
| DE | 198 17 000 | 10/1998 |
| DE | 199 13 016 | 10/1999 |
| EP | 0291193 A1 * | 4/1988 |

* cited by examiner

*Primary Examiner*—David J Bagnell
*Assistant Examiner*—Benjamin Fiorello
(74) *Attorney, Agent, or Firm*—Fay Kaplun & Marcin, LLP

(57) ABSTRACT

Described is a method for the trenchless underground laying of pipes. According to said method, a shield tunnel boring machine and then subsequently pipes are driven through the ground starting from a starting shaft. The shield tunnel boring machine produces a borehole whose diameter is slightly greater than the outer diameter of the pipes. The annular space between the borehole wall and the pipes thereby obtained is filled with a supporting and lubricating agent. During advance, a continuous and periodical examination of the composition of the ground is carried out in the area of the shield tunnel boring machine or the first pipe following the shield tunnel boring machine or the first lubricating point. Depending on the result of the examination, the ground in the examined area is sealed off and/or solidified by a sealing and/or solidifying agent and/or the composition of the supporting and lubricating agent is adjusted.

16 Claims, 2 Drawing Sheets

METHOD AND DEVICE FOR TRENCHLESS LAYING OF PIPELINES

FIELD OF THE INVENTION

The present invention relates to a method for trenchless underground laying of pipelines and also to a device for implementing this method.

BACKGROUND INFORMATION

In the laying of supply and waste pipes above all in areas within towns, technical and economic requirements resulting from the presence of sensitive living spaces, dense mains systems and much used highways have led to the fact that the closed construction method relative to the open construction method is continually gaining in importance. Pipe advance counts amongst the most important construction methods in this respect for trenchless laying of sewers, water pipes, protected and jacketed tubes, ducts and conduits.

In this method, advance pipes are driven through the subsoil into a target shaft starting from a starting trench with the help of a main pressing station and assistance of intermediate pressing stations. The advance in straight or curved line guidance is thereby made possible by a controllable shield tunnel boring machine which is disposed in front of the first pipe. The stone is broken up at the front location mechanically over a partial or full surface area and is conveyed away to above ground by the advanced piping. As a function of the outer diameter there are used advance pipes premanufactured in a factory, as a rule with a circular annular cross section $1200 \leqq DN/ID \leqq 3000$, or advance pipes produced in a factory on site with even greater nominal width.

Pressing-in of shield tunnel boring machine and piping is effected with the help of the advance force produced by the pressing station. It serves for overcoming the penetration resistance of the bore head into the existing subsoil and the frictional resistances along the peripheral surface area of the shield tunnel boring machine and also the subsequent piping in the ground (surface friction). In order to be able to control the advance in the vertical and horizontal direction, the dimension of the borehole produced by the advance machine is slightly greater than the outer diameter of the advance pipes so that these can be angled off relative to each other within the borehole and hence the pipes which are connected to each other in an articulated manner to form piping can follow the direction changes forced by the shield tunnel boring machine without or with only slight jamming. The dimension by which the borehole radius exceeds the pipe outer radius is termed annular gap (or annular space from a spatial point of view). The annular space is generally, in particular when advancing in unstable loose stone, filled with a so-called supporting and lubricating agent which, on the one hand, supports the soil from falling into the annular space and in addition reduces the required advance forces because of its friction-reducing effect between ground and pipe outer surface. For this purpose, the supporting and lubricating agent is under pressure, the level of which is dependent in particular upon the horizontal and vertical earth or soil pressure, the groundwater pressure, the permeability of the soil, the annular space dimensions and also the rheological properties of the supporting and lubricating agent.

A problem which occurs frequently in practice is presented by supporting and lubricating agent losses and pressure drops which go beyond a tolerable amount, with significant consequences for the further course of the advance operations as far as advance standstill or impermissible stressing of the pipes.

During lubrication and supporting of the annular space, liquid, solid-free and solid-containing liquids (so-called drilling fluids) are used nowadays, in particular water, bentonite drilling fluids or bentonite-polymer drilling fluids.

The supporting is achieved with the help of a corresponding pressure impingement of drilling fluid, it requiring to be ensured that the pressure of the supporting liquid at any place to be supported must be greater than the pressure due to the groundwater and subsoil.

In stable, groundwater-conducting subsoil, the supporting agent pressure need merely counteract the prevailing groundwater pressure. For this application case, all the previously mentioned drilling fluids are suitable.

In unstable subsoil, the respectively used supporting agent must develop a mechanism with the ground to be supported which makes it possible to transmit in full the difference of the pressure of the supporting agent and of the prevailing earth and/or groundwater pressure to the grain structure of the existing ground. For this application case, in particular solid-containing supporting agents, such as e.g. bentonite drilling fluids and bentonite-polymer drilling fluids which have a corresponding flow limit, are suitable.

In the case of bentonite drilling fluids or bentonite-polymer drilling fluids, transmission of the pressure difference to the grain structure is effected in a time-independent manner if a zone is formed at the surface or up to a certain penetration depth in the region close to the surface of the borehole wall, the permeability of which zone is less than that of the existing ground. In this zone, the differential pressure between the supporting agent side and the soil to be supported is converted into an effective pressure acting on the grain structure.

At the interface between ground and bentonite drilling fluid or bentonite-polymer drilling fluid, a thin layer accumulates in addition in particular in the case of higher supporting agent pressure, said layer comprising superposed bentonite particles. This layer—also termed filter cake—seals the interface of the cavity wall and thus assists transmission of the supporting agent pressure to the grain structure.

The formation of impermeable zones or of the filter cake is however only successful when the bentonite particles which are dispersed in the bentonite drilling fluid or bentonite-polymer drilling fluid are larger than the smallest pores in the existing soil or freely occurring polymer particles block any still available pores mechanically-physically as a result of their moveability and plasticity.

The field of use of bentonite drilling fluids extends therefore to coarse-grain, loose to densely packed sand and gravels, non-uniform and non-homogeneous soils with water permeability coefficients of $k_f > 10^{-5}$ m/s.

Bentonite-polymer drilling fluids comprise water as basic material to which bentonite and polymers are added. They are used preferably in coarse-grain soils with open structures, such as e.g. uniform coarse gravels in order to avoid outflows and in addition in clay soils which are inclined to swell and stick together. In practice, the most varied of types of polymers are used in the present application case. They thereby serve for example for filtrate reduction, as protective colloid and for viscosity regulation.

The problems of the existing method technique for supporting the annular gap and lubricating the piping are characterised by the following factors:

a) The modification of supporting agents with the help of additives and in particular polymers is essentially dependent upon the experience of the employees working on the building site. There are in fact corresponding operational guidelines for using polymers, such as e.g. the instructions W 116 of the DVGW (German Association of Gas and Water Applications), "Use of drilling fluid supplements in bore drilling fluids in boring works in groundwater" with corresponding dosage recommendations for the respective drilling fluid formulation; however because of the wide range of available types of polymers with different modes of operation, these should be regarded rather as generally valid handling recommendations. For the specific application case, in practice as a rule separate "experiments" are therefore implemented in order to identify suitable, modified supporting agents or self-formulated supporting agents are used. The danger exists however hereby that combinations of a plurality of polymers can lead to undesired reactions.

b) The automatic lubricating systems used to date inject continuously the previously established supporting and lubricating agent into the annular gap via lubricating stations integrated in the piping. Injection agent quantities and pressures for each lubricating station are thereby individually adjustable. Since, however, all the lubricating stations are supplied with the supporting and lubricating agent via a closed circulation from a single container or mixer installed in the region of the starting shaft, it is not possible, along the advance route, to react at the individual lubricating stations to changing geological structures with different supporting and lubricating agents which are suitable for the respective application case.

c) In loose, pebbly soils, the danger exists furthermore that the annular gap being dug collapses directly behind the shield tail over the piping. In this case there are no possibilities for producing the annular gap again. This situation must definitely be avoided since the surface friction increases abruptly and, upon reaching the pressing capacity, the danger exists of stalling of the advance.

In order to reduce the advance forces or surface friction, a microtunnel construction method was developed for use with groundwater in highly water-permeable soils, said method being used with the description "Support membrane depot box system". This method is characterised in that, moving forward with the advance, an endless tube which is mounted in a magazine in the trailer of the advance machine and comprising soft PVC with a thickness of 0.3 mm is unwound, said tube enveloping the advance pipes. Parallel hereto the region between the tube and advance pipe and also between tube and exposed soil is injected under pressure with a bentonite suspension. There should be mentioned as disadvantages of this technology, which stand in the way of wider use, a very complex construction of shield tail and trailer, relatively large spatial requirement for the tube magazine and also the risk of damage to the tube.

SUMMARY OF THE INVENTION

The present invention describes a method and a device for trenchless underground laying of pipelines, in which, from a starting shaft, a shield tunnel boring machine and pipes following the latter are driven through the ground, the shield tunnel boring machine producing a borehole, the diameter of which is slightly larger than the outer diameter of the pipes and the annular space existing between the borehole wall and the pipes being filled with a supporting and lubricating agent, with which suddenly occurring supporting and lubricating agent losses or pressure drops due to soil regions of a different condition can be avoided.

As a result of the fact that, during the advance, at least in the region of the shield tunnel boring machine or of the first pipe following the shield tunnel boring machine or of the first lubricating station, a continuous or periodic examination of the condition of the ground is carried out and, dependent upon the result of the examination, the ground in the examined region is sealed and/or solidified by a sealing and/or a solidifying medium and/or the composition of the supporting and lubricating agent is adjusted, the ground can be prepared by the sealing and/or solidifying medium such that it has sufficient density and stability for the prepared supporting and lubricating agent, or, by corresponding adjustment of the composition of the supporting and lubricating agent, this can be adapted during the pipe advance to the respective ground condition.

The examination is effected preferably in such a manner that the density or permeability of the borehole wall is tested by means of a test medium under pressure, in that the loss in quantity or pressure loss of the test medium is expediently determined. The method can be implemented in particular very simply as a result of the fact that the supporting and lubricating agent itself with a predetermined composition is used as test medium.

The sealing and/or solidifying medium is advantageously injected under pressure into the ground and changes in the latter into a gel-like or solid state. A two or multicomponent medium can be used expediently for this purpose.

A device according to the invention for implementing this method has, in the region of the shield tunnel boring machine or in one of the front pipes or the first lubricating station, a first test and injection device for the supporting and lubricating agent and also for the sealing and/or solidifying medium. In this, preferably all the devices required for testing, sealing and/or solidifying, i.e. all the regulating, checking and control devices and measuring appliances (throughflow, pressure meter) and also all the devices for storing, mixing and injecting under pressure, the supporting and lubricating agent, on the one hand, and the sealing and/or the solidifying medium on the other hand are contained. Furthermore, the test and injection device advantageously has openings which discharge into the annular space and can be connected to supply lines for the supporting and lubricating agent and also the sealing and/or solidifying medium. The openings are expediently distributed uniformly in the circumferential direction and, if required, can be actuated individually. As a result—in particular when using high-viscosity suspensions or pastes—uniform pressure conditions can be achieved in the region of the annular space.

In the annular space, preferably at least two blocking elements (packers) which delimit the annular space in the longitudinal direction of the pipe are provided between the borehole wall on the one hand and the piping on the other hand, which blocking elements can be expanded in the radial direction. It is advantageous that the mutual spacing of the blocking elements can be changed in the longitudinal direction, in particular a front blocking element in the region of the shield tunnel boring machine or of one of the front pipes or of the first lubricating station being disposed moveably with the latter and a rear one being disposed in a stationary manner in the region of the starting shaft. A further blocking element can be provided approximately one pipe length behind the front blocking element, as a result of which the testing chamber is sealed relative to the remaining annular chamber of the already laid piping, so that, in the remaining annular space, the suspension pressure defined for safeguarding the advance can be maintained during the examination.

BRIEF DESCRIPTION OF DRAWINGS

The present invention is explained subsequently in more detail with reference to an embodiment represented in the Figures. There are shown.

DETAILED DESCRIPTION

Figure 1:
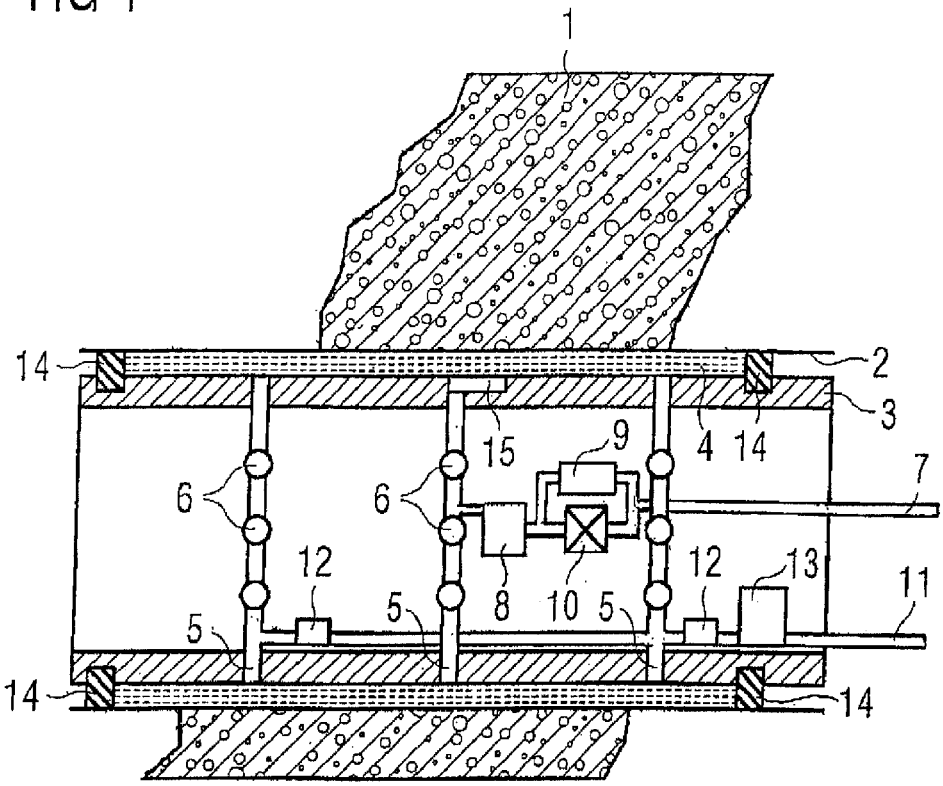
FIG. 1 shows a test and injection device in longitudinal section according to an exemplary embodiment of the present invention.
Figure 2:
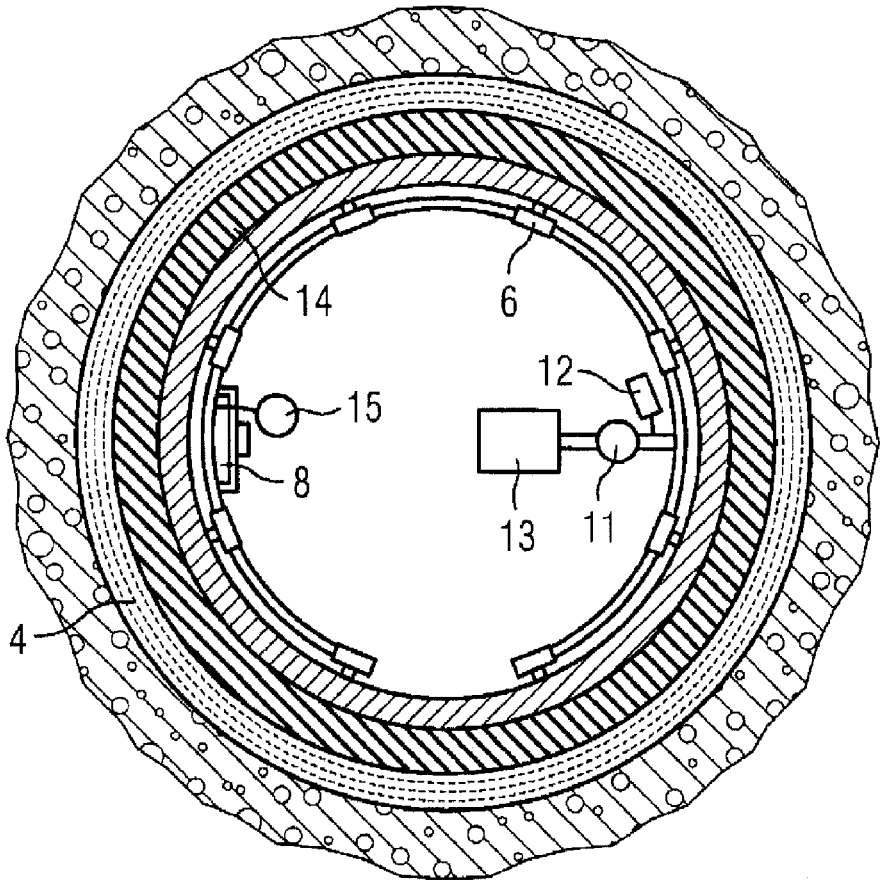
FIG. 2 shows the test and injection device according to FIG. 1 in cross-section.

FIGS. 1 and 2 show a borehole 2 which is surrounded by the ground 1 and into which piping comprising individual pipes is introduced. The borehole 2 is produced by a shield tunnel boring machine which is disposed in front of (in FIG. 1 on the left-hand side) the piping and advanced in the forward direction (in FIG. 1 to the left), an annular space 4 being maintained between the wall of the borehole 2 and the individual pipes 3. A trailing pipe can be provided if necessary between the shield tunnel boring machine and the first of the following pipes 3.

The illustrated pipe 3, which is for example the first pipe behind the shield tunnel boring machine or at the first lubricating station, contains a test and injection device with three annular injection lines 5 which abut on the inner wall of the pipe 3 and, in the circumferential direction at uniform mutual spacings, have injection connection pipes 6 which are guided radially through borings in the pipe 3 and discharge into the annular space 4. A supply line 7 drawn through the piping is connected to the central injection line 5 and serves for delivering the supporting and lubricating agent to the central injection line 5. In the supply line 7 there is situated a central control unit 8 for the supporting and lubricating agent injection and also the permeability check including the volume flow measurement during the examination phase, a mixing device 9 for modifying the supporting and lubricating agent in a bypass line and also a stop valve 10 for the bypass line. A supply line 11 which likewise extends from the starting shaft through the piping is connected to the two outer injection lines 5, through which supply line the sealing and/or solidifying medium or else supplements for the supporting and lubricating agents are delivered. Also in this supply line 11 there are situated control units 12 for the injection of the sealing and/or solidifying medium or of the supplements and also a mixing unit 13 for the sealing and/or solidifying medium. The possibility also exists however of coupling each of the supply lines 7 and 11 to all three injection lines 5, the respective coupling state being maintained via individually controllable stop valves.

In front of and behind the test and injection device there is situated, between the outer wall of the pipe 3 and the wall of the borehole 2, respectively one blocking element 14 (packer) which can be inflated pneumatically or hydraulically so that, in the inflated state thereof, the annular space 4 between the blocking elements 14 is separated from that—if present—blocking element 14 in front of the front one and the one behind the rear one. The front blocking element 14 can however also be disposed in the region of the shield tunnel boring machine or of a trailing pipe following the latter directly; a shield tail seal can hereby assume the function of the blocking element 14 or the blocking element 14 can be configured in the form of a shield tail seal. In addition, another stationary blocking element is generally provided in the region of the starting shaft, preferably in the spectacle wall, which blocking element seals the annular space 4 between the rear blocking element 14 and the starting shaft so that, in the latter, the suspension pressure defined to safeguard the advance, can be maintained during testing. The two blocking elements 14 shown move in contrast corresponding to the advance of the piping through the borehole whilst maintaining a constant mutual spacing.

Finally, the Figures illustrate another measuring device 15 for detecting the injection/supporting pressure in the annular space 4.

During the advance of the shield tunnel boring machine with subsequent piping, the supporting and lubricating agent delivered via the supply line 7, in the form of water, a bentonite suspension or a bentonite-polymer suspension, which has a composition which is suitable for the probable subsoil, is injected under pressure into the annular space 4 by the injection connection pipes 6. By means of the measuring device in the control unit 8 and the measuring device 15, approximate losses in supporting and lubricating agent or pressure drops are measured and the condition of the ground is determined therefrom. If it results that the ground 1 at the measuring point has too great a permeability, then the possibility exists of injecting under pressure into the ground 1 a sealing and/or solidifying medium via the supply line 11, the injection lines 5 and the injection connection pipes 6 and, consequently, in a temporary manner, i.e. at least for the duration of the pipe advance, of sealing and/or solidifying it such that the losses of the supporting and lubricating agent used are minimised. Such a medium is suitable, the properties (in particular consistency and viscosity) and particle sizes of which are created such that it penetrates into the ground when supplied with pressure and after removal of pressure remains in the latter and, after an adjustable time, changes there into a gel-like or solid state. The medium can be specially formulated and mixed in the mixing unit 13 as a function of the permeability of the ground 1. Also recourse can thereby be made to the entire range available both of chemically active and chemically non-active additives including fillers and plugging agents. Both pastes and suspensions and solutions can be used. Care must thereby be taken in all circumstances that the annular space 4 is maintained.

The ground 1 can be sealed and/or solidified already in the region of the shield tunnel boring machine jacket through injection openings integrated in the latter with a special injection agent, the jacket functioning as a sliding shell until the injected soil has sufficiently high strength or sufficiently low permeability to maintain the subsequently exposed annular gap. The outer surface of the jacket can be provided for this purpose with an adhesion-reducing layer or an injection agent can be used which does not adhere to the jacket.

The sealing and/or solidifying medium can be injected ready-mixed or two or more components of the latter can be introduced into the ground in two or more successive phases.

The non-active supplements, such as fillers and plugging agents, can be supplied in addition to the supporting and lubricating agent so that the composition thereof is correspondingly changed in the annular space 4 and the permeability of the ground 1 is consequently reduced for this.

For practical reasons, testing of the ground permeability with the supporting and lubricating agent of a predetermined composition itself is implemented. It is however also possible to use a separate testing medium for this purpose. This however increases the necessary complexity with respect to appliances and methods.

The examination of the ground condition and the approximate sealing and/or solidifying of the borehole wall are effected in all advance phases, preferably in down times of the piping for example during installation of a further pipe in the starting shaft or during advance of the shield tunnel boring machine with the help of a telescopic device installed in the latter. Thereafter, the advance of the piping can be continued by for example a pipe length, the blocking elements 14 being deactivated and the pressure in the annular gap 4 being maintained. The blocking elements 14 can be situated, for protection from mechanical damage during advance, in pockets provided on the outside of the shield tunnel boring machine or of the pipe 3, said pockets being able to be provided if necessary with a moveable cover. The test and injection device is advanced with the piping so that the examination can be implemented again in a different ground region.

After holing-through, sealing and/or solidifying of the established inhomogeneity of the subsoil, the further advance can be implemented with the supporting and lubricating agent prepared for the probable subsoil.

It can be recommended to provide, a few pipe lengths behind the test and injection device which is installed directly behind the pipe boring machine, a further device of this type, with which renewed testing and, if necessary, correction of the ground permeability can be undertaken.

The invention claimed is:

1. A method, implemented by a device, for a trenchless underground laying of pipelines, comprising:

from a starting shaft, driving through a ground a shield tunnel boring machine and pipes following the machine;

producing a borehole using the machine, a diameter of the borehole being slightly larger than an outer diameter of the pipes;

filling an annular space existing between the borehole wall and the pipes with a supporting and lubricating agent;

during an advance of the pipes, at least in a region of one of (i) the machine, (ii) a first pipe of the pipes following the machine and (iii) a first lubricating station, examining a condition of the ground, the examining step being performed in one of (i) a continuous manner and (ii) a periodic manner;

performing at least one of the following step based on a result of the examining step:

(i) at least one (a) sealing and (b) solidifying the ground in the examined region using at least one of a sealing medium and a solidifying medium; and (ii) adjusting a composition of the supporting and lubricating agent;

wherein the device includes:

(a) a first test and injection device having a supporting and lubricating agent and at least one of a sealing medium and a solidifying medium, the first test and injection device being situated in one of (i) a region of a shield tunnel boring machine and (ii) a region of one of front pipes; and (b) supply lines supplying to the first test and injection device at least one of (i) the supporting and lubricating agent and (ii) at least one of the sealing medium and the solidifying medium, wherein the test and injection device has openings which discharge into an annular space, the test and injection device being connected to at least one of the supply lines, wherein the openings are disposed distributed uniformly in a circumferential direction, and wherein, in order to achieve uniform pressure conditions in the annular space, the openings are individually controlled and activated.

2. The method according to claim 1, further comprising: testing one of (i) a sealing of a borehole wall and (ii) a permeability of the borehole wall using a test medium.

3. The method according to claim 2, further comprising:

determining one (i) a loss in quantity of the test medium and (ii) a pressure loss of the test medium.

4. The method according to claim 1, wherein the supporting and lubricating agent with a predetermined composition is utilized as a test medium.

5. The method according to claim 1, wherein the supporting and lubricating agent is one of (I) water, (ii) a bentonite suspension and (iii) a bentonite-polymer suspension.

6. The method according to claim 1, further comprising:

injecting under a pressure into the ground one of the sealing medium and the solidifying medium in order to at least one of seal and solidify the ground so that the ground changes into one of a gel-like state and a solid state.

7. The method according to claim 6, wherein at least one of the sealing medium and the solidifying medium is at least two component medium, the method further comprising: injecting the at least two component medium in at least two successive phases.

8. The method according to claim 1, wherein the examining and performing steps are repeated at a spacing of a few pipe lengths.

9. A device, comprising:

a first test and injection device having a supporting and lubricating agent and at least one of a sealing medium and a solidifying medium, the first test and injection device being situated in one of (i) a region of a shield tunnel boring machine and (ii) a region of one of front pipes; and supply lines supplying to the first test and injection device at least one of (i) the supporting and lubricating agent and (ii) at least one of the sealing medium and the solidifying medium, wherein the test and injection device has openings which discharge into an annular space, the test and injection device being connected to at least one of the supply lines, wherein the openings are disposed distributed uniformly in a circumferential direction, and wherein, in order to achieve uniform pressure conditions in the annular space, the openings are individually controlled and activated.

10. The device according to claim 9, further comprising: a controllable mixing unit adjusting of rheological properties of at least one of the sealing medium and the solidifying medium, the controllable mixing unit being situated in a first line of the lines which supplies only at least one of the sealing medium and the solidifying medium.

11. The device according to claim 9 further comprising: at least two blocking elements delimiting an annular space in a longitudinal direction of the pipes, the at least two blocking elements being situated between a borehole wall and the pipe.

12. The device according to claim 11, wherein the at least two blocking elements expand one in a pneumatic manner and a hydraulic manner in a radial direction.

13. The device according to claim 11, wherein a mutual spacing of the at least two blocking elements changes in a longitudinal direction.

14. The device according to claim 13, wherein the at least two blocking elements includes first and second blocking elements, wherein, in a region of one of (i) the shield tunnel boring machine, (ii) one of front pipes and (iii) a first lubricating station, the first blocking element is situated moveably with the second blocking element, and wherein the second blocking element is situated in a stationary manner in a region of the starting shaft.

15. The device according to claim 14, wherein the at least two blocking elements includes a third blocking element which is situated approximately one pipe length behind the first blocking element.

16. The device according to claim 9, further comprising: a second test and injection device being situated in the pipes several pipe lengths behind the first test and injection device.

* * * * *